US006857199B2

(12) United States Patent
Otani et al.

(10) Patent No.: US 6,857,199 B2
(45) Date of Patent: Feb. 22, 2005

(54) DRYING SAND MOLD FOR PULP MOLDINGS

(75) Inventors: Kenichi Otani, Tochigi (JP); Shingo Odajima, Tochigi (JP); Tokihito Sono, Tochigi (JP)

(73) Assignee: Kao Corporation, Tokyo (JP)

( * ) Notice: Subject to any disclaimer, the term of this patent is extended or adjusted under 35 U.S.C. 154(b) by 134 days.

(21) Appl. No.: 10/203,774

(22) PCT Filed: Mar. 19, 2001

(86) PCT No.: PCT/JP01/02160

§ 371 (c)(1),
(2), (4) Date: Aug. 13, 2002

(87) PCT Pub. No.: WO01/71095

PCT Pub. Date: Sep. 27, 2001

(65) Prior Publication Data

US 2003/0009903 A1 Jan. 16, 2003

(51) Int. Cl.[7] ..... F26B 9/04; D21J 3/00

(52) U.S. Cl. ..... 34/146; 34/103; 34/106; 34/144; 34/224; 34/234; 34/235; 162/378; 162/379

(58) Field of Search ..... 34/103, 104, 106, 34/143, 144, 145, 146, 201, 218, 222, 223, 224, 234, 235, 237; 162/375, 376, 378, 379

(56) References Cited

U.S. PATENT DOCUMENTS 1,955,249 A * 4/1934 Morris ..... 162/378
1,983,553 A * 12/1934 Manson ..... 162/378
2,321,756 A * 6/1943 Kyle ..... 34/145
2,471,932 A * 5/1949 Chaplin ..... 162/223
2,961,043 A 11/1960 Hicks
6,332,956 B1 * 12/2001 Lee et al. ..... 162/378
6,454,906 B1 * 9/2002 Nonomura et al. ..... 162/220
6,461,480 B1 * 10/2002 Otakura et al. ..... 162/220
6,468,398 B1 * 10/2002 Kumamoto et al. ..... 162/220
6,521,085 B2 * 2/2003 Kumamoto et al. ..... 162/130
6,547,931 B1 * 4/2003 Kumamoto et al. ..... 162/219

FOREIGN PATENT DOCUMENTS

| | | |
|---|---|---|
| JP | 06-158599 | 6/1994 |
| JP | 08-049200 | 2/1996 |
| JP | 08-260400 | 10/1996 |
| JP | 9-188987 | 7/1997 |
| JP | 2000-34699 | 2/2000 |

* cited by examiner

*Primary Examiner*—Pamela A Wilson
(74) *Attorney, Agent, or Firm*—Oblon, Spivak, McClelland, Maier & Neustadt, P.C.

(57) ABSTRACT

A drying mold 1 for a pulp molded article has a first mold member 10, a second mold member 20, and a third mold member 30. The first mold member 10 has a drying portion 12 and first passageways 13*a* and 13*b* connecting the drying portion 12 to an exterior surface of the first mold member 10. The second mold member 20 has a prescribed heating means and is disposed in contact with the exterior surface of the third mold member 30. The third mold member 30 is disposed in contact with the exterior surface of the first mold member 10. The drying mold 1 is designed to form second passageways 2*a* and 2*b* between the first and the third mold members when the first and the third mold members are disposed in contact with each other. The passageways 2*a* and 2*b* connect the first passageways 13*a* and 13*b* to the outside of the drying mold 1.

12 Claims, 4 Drawing Sheets

DRYING SAND MOLD FOR PULP MOLDINGS

TECHNICAL FIELD

The present invention relates to a drying mold and a drying apparatus for drying a water-containing pulp molded article made by a wet papermaking process.

BACKGROUND ART

JP-A-8-260400 discloses a drying mold aiming at rapidly drying a pulp molded article by efficiently supplying heat energy to the article. The drying mold has a thick mold member having a large number of vent holes, a frame member which provides a hollow chamber in the back of the thick mold member and has a compressed air feed pipe connecting to the hollow chamber, and a heating means embedded in the thick mold member.

Because the heating means of the drying mold is in the thick mold member, it is near the article to be dried. Therefore, where an article has a complicated shape, the degree of drying can vary from part to part, resulting in non-uniform drying. For example, drying can proceed excessively in some parts of an article, resulting in discoloration or scorches of pulp, while some other parts remaining wet. The number of the heating units must be increased in order to prevent non-uniform drying, which will increase the production cost of the mold.

Where articles of different shapes are to be dried, as many thick mold members as the shapes should be prepared. Having heating means embedded therein, the thick mold member is costly and has little flexibility to the shapes of articles.

In case the heating means is exchanged as the life expires, the whole thick mold member must be renewed, which is bad economy. Exchanging only the heating means with a new one requires removal of the embedded heating means from the thick mold member. That is, the thick mold member has poor maintainability.

DISCLOSURE OF THE INVENTION

Accordingly, an object of the present invention is to provide a drying mold and a drying apparatus whereby a wet pulp molded article can be dried with little non-uniformity of drying Another object of the present invention is to provide a drying mold and a drying apparatus which are flexible in drying articles of various shapes.

Still another object of the present invention is to provide a drying mold and a drying apparatus having excellent maintainability.

The present invention accomplishes the above objects by providing a drying mold for a pulp molded article having a first mold member, a second mold member, and a third mold member, wherein said first mold member has a drying portion which is brought into contact with a wet pulp molded article, said first mold member has a linear first passageway connecting said drying portion to an exterior surface of said first mold member, said second mold member has a prescribed beating means and is disposed in contact with the exterior surface of said first mold member or in contact with said third mold member, said third mold member is disposed in contact with the exterior surface of said first mold member, and said drying mold is designed to form a linear second passageway between said first mold member and said third mold member when said first mold member and said third mold member are disposed in contact with each other, said second passageway connects said first passageways to the outside of said drying mold and is perpendicular to the first passageway (hereinafter sometimes referred to as a first aspect of the invention).

The present invention also accomplishes the above objects by providing a drying mold for a pulp molded article having a first mold member and a second mold member, wherein said first mold member has a drying portion which is brought into contact with a wet pulp molded article, said first mold member has a first passageway connecting said drying portion to an exterior surface of said first mold member, said second mold member has a prescribed heating means and is disposed in contact with the exterior surface of said first mold member, and said drying mold is designed to form a linear second passageway between said first mold member and said second mold member when said first mold member and said second mold member are disposed in contact with each other, said second passageway connects said first passageways to the outside of said drying mold and is perpendicular to the first passageway (hereinafter sometimes referred to as a second aspect of the invention).

The present invention further provides a drying apparatus for a pulp molded article having a drying mold according to the first aspect of the invention and a platen to which the drying mold is fixed, wherein the drying mold is attached and fixed to the platen on the side of the second mold member thereof or the third mold member thereof The present invention furthermore provides a drying apparatus for a pulp molded article having a drying mold according to the second aspect of the invention and a platen to which the drying mold is fixed, wherein the drying mold is attached and fixed to the platen on the side of the second mold member thereof.

BRIEF DESCRIPTION OF THE INVENTION

Figure 1:
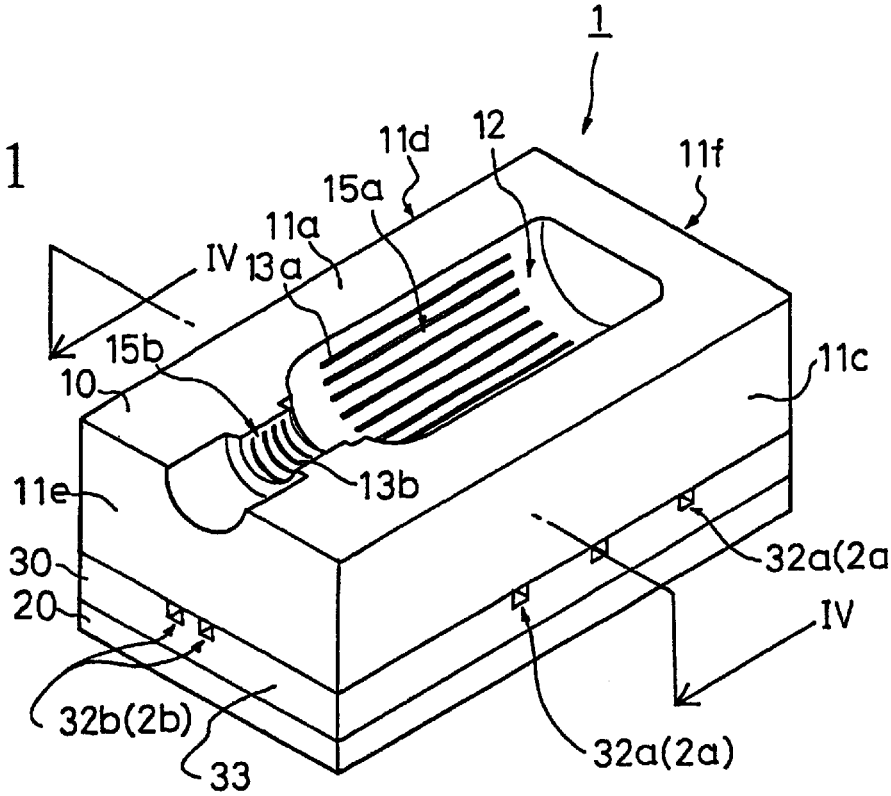
FIG. 1 is a perspective view of a drying mold for a pulp molded article according to a first embodiment of the first aspect of the invention.

FIGS. 5(*a*), 5(*b*), 5(*c*), and 5(*d*) schematically show the step of drying a pulp molded article by use of the drying mold shown in FIG. 1.

Figure 4:
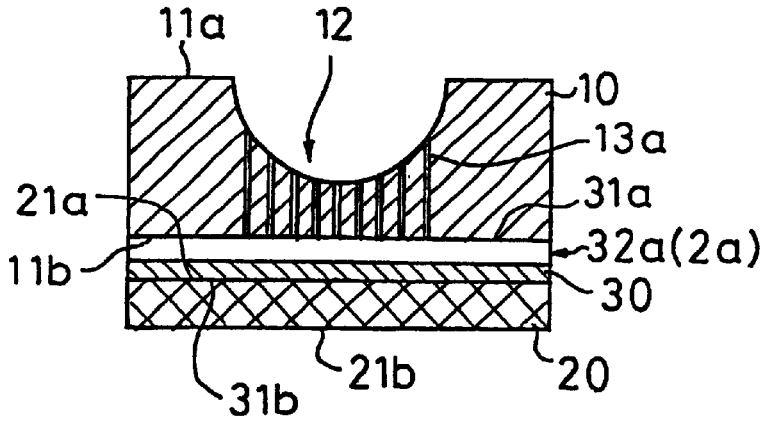
FIG. 4 is a cross-sectional view of the drying mold shown in FIG. 1, taken along line IV—IV.
Figure 5A:
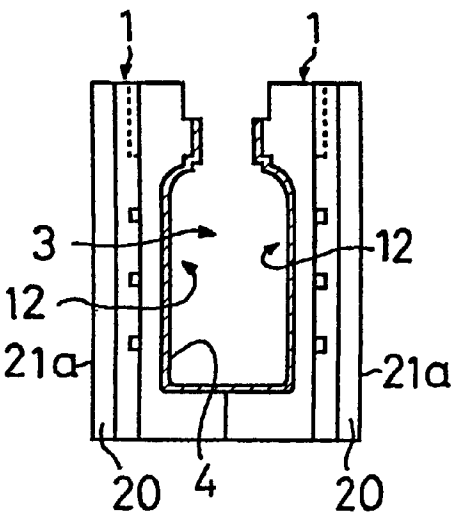
Figure 5B:
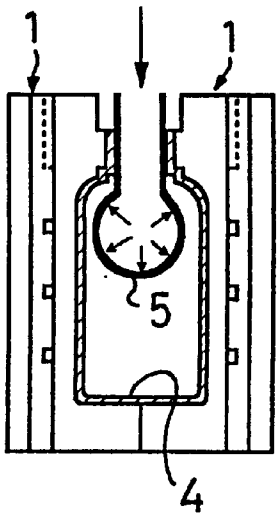
Figure 5C:
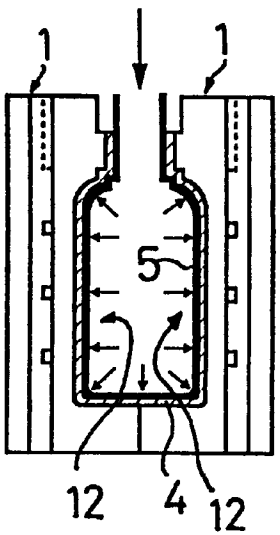
Figure 5D:
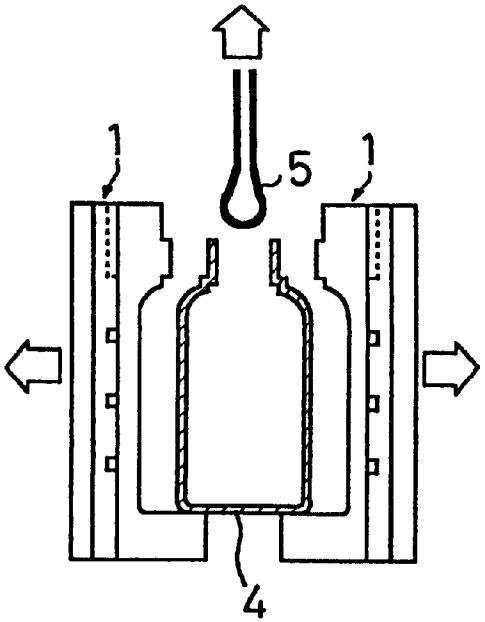
Figure 6:
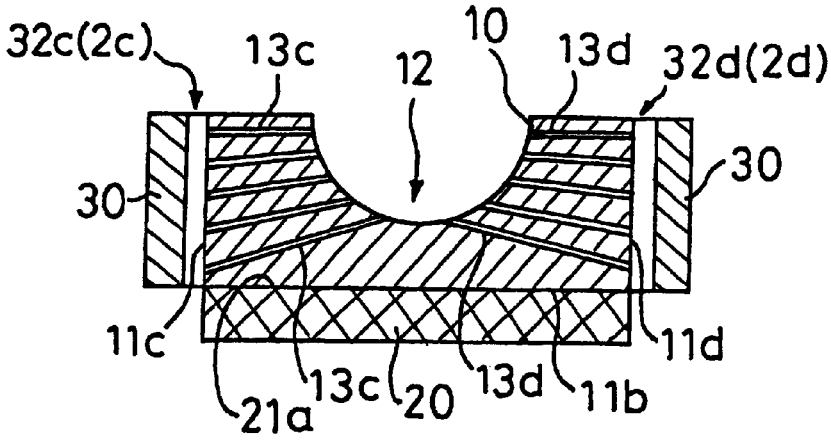

FIG. 6 is a cross-sectional view of a drying mold for a pulp molded article according to a second embodiment of the first aspect of the invention (corresponding to FIG. 4).

Figure 7:
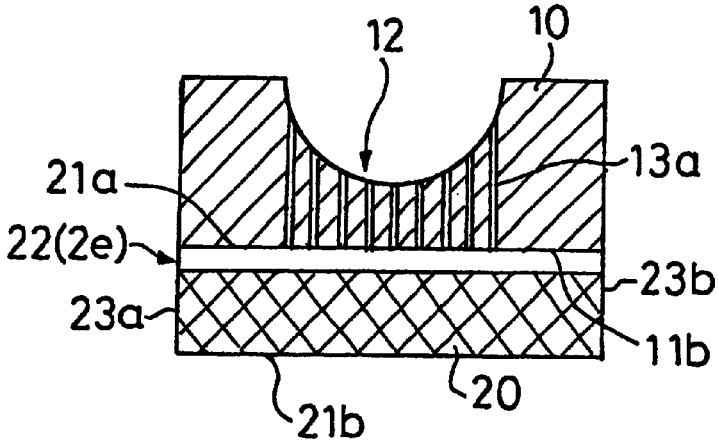

FIG. 7 is a cross-sectional view of a drying mold for a pulp molded article according to a first embodiment of the second aspect of the invention (corresponding to FIG. 4).

BEST MODE FOR CARRYING OUT THE INVENTION

Figure 2:
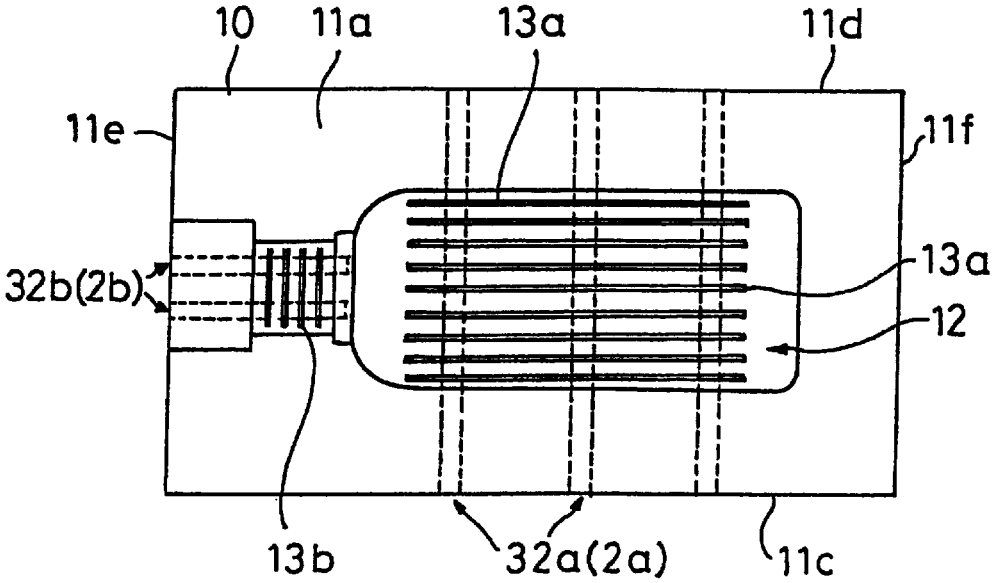
FIG. 2 is a plan view of the drying mold shown in FIG. 1.
Figure 3:
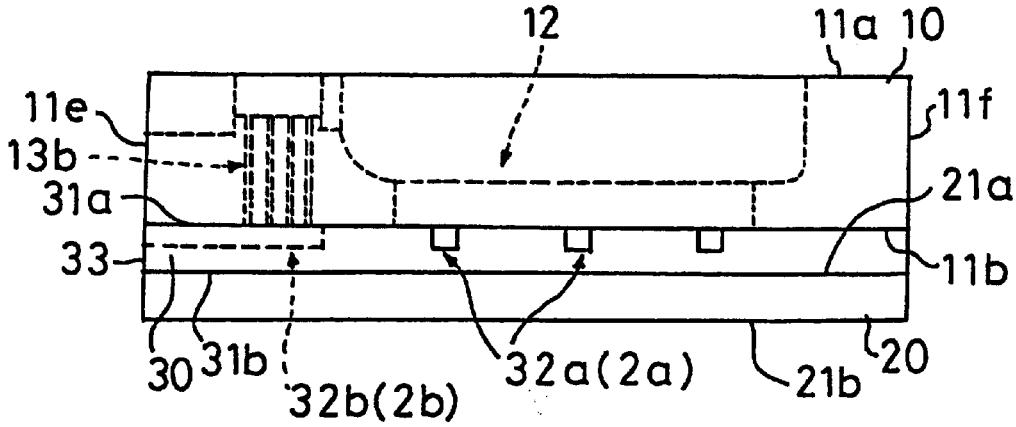
FIG. 3 is a side view of the drying mold shown in FIG. 1.

Preferred embodiments of the drying mold according to the first aspect of the invention will be described with reference to the drawings. FIG. 1 is a perspective of a drying mold according to a first embodiment of the first aspect of the invention. FIGS. 2 to 4 show the plan view, the side view, and the cross-sectional view taken along line IV—IV, respectively, of the drying mold shown in FIG. 1.

The drying mold 1 according to this embodiment is used to dry a water-containing pulp molded article (i.e., preform) obtained by a prescribed wet papermaking process. The molded article is a hollow molded article having the shape of a cylindrical bottle composed of a neck, a shoulder, a body, and a bottom. The drying mold 1 has a first mold member 10, a second mold member 20, and a third mold member 30.

The first mold member 10 is made of a rectangular parallelepipedal block with a top face 11*a*, a bottom face 11*b*, a pair of side faces 11*c* and 11*d*, a front face 11*e*, and a rear face 11*f*. The bottom face 11*b*, the side faces 11*c* and 11*d*, and the front and rear faces 11*e* and 11*f* constitute the exterior surface of the first mold member 10. The first mold member 10 is solid and thick and therefore has a sufficiently large heat capacity.

The top face 11*a* has a concave depression 12 that fits a vertical half of a wet preform molded by a prescribed wet papermaking process. This depression 12 constitutes the drying portion which is to be brought into contact with a preform. The top face 11*a* of the first mold member 10 is flat, serving as a parting face (described later) of the drying mold 1.

The depression 12 of the first mold member 10 has air passageways of slit form as passageways (first passageways) connecting the depression 12 and the bottom face 11*b*, part of the exterior surface of the first mold member 10. More specifically, the depression 12 has air passageways 13*a* which are made in the portion 15*a* mating the body portion of the molded article where a label is to be stuck (hereinafter referred to as a label portion 15*a*) and air passageways 13*b* which are made in the portion 15*b* mating the neck (hereinafter referred to as a neck portion 15*b*).

The air passageways 13*a* are a plurality of slits parallel to the longitudinal direction of the preform. The air passageways 13*a* pierce from the surface of the label portion 15*a* to the bottom face 11*b* of the first mold member 10. The air passageways 13*b* are a plurality of slits parallel to the direction perpendicular to the longitudinal direction of the preform. The air passageways 13*b* pierce from the surface of the neck portion 15*b* to the bottom face 11*b* of the first mold member 10.

The width of each passageway 13*a* or 13*b* of slit form (the width on the surface of the depression 12) is preferably 0.04 to 2 mm, still preferably 0.2 to 0.5 mm, for assuring ease of making and maintaining the air passageways and for preventing the air passageways from leaving marks on the outer surface of the resulting molded article to improve the appearance of the molded article. The width of the air passageways 13*a* and 13*b* on the surface of the depression 12 taken as a, and that on the bottom face 11*b* of the first mold member 10 as b, it is desirable that a be equal to or smaller than b for further increasing efficiencies in steam discharging and drying.

The opening ratio of the air passageways 13*a* and 13*b* of slit form to the area of the depression 12 preferably ranges from 0.5 to 70%, particularly 2 to 70%, from the standpoint of steam discharging efficiency and uniformity of drying. The air passageways 13*a* and 13*b* of slit form can easily be made in a short time by means of a wire discharge cutter, a laser, etc.

The second mold member 20 is made of a thin rectangular parallelepipedal block having the same silhouette as the first mold member 10 when viewed from the above. The second mold member 20 has a top face 21*a* and a bottom face 21*b*. The top face 21*a* is in contact with the bottom face 31*b* of the third mold member 30 as described later, and the bottom face 21*b* constitutes the back side of the drying mold 1. The second mold member 20 has a heating means (not shown), such as an electric heater, removably disposed in the inside thereof.

The third mold member 30 is also made of a thin rectangular parallelepipedal block having the same silhouette as the first mold member 10 and the second mold member 20 when seen from the above. The third mold member 30 has a top face 31*a* and a bottom face 31*b*, and the bottom face 31*b* is in contact with the top face of the second mold member 20 as described above. The top face 31*a* of the third mold member 30 is in contact with the bottom face 11*b*, part of the exterior surface of the first mold member 10.

The top face 31*a* of the third mold member 30 has grooves 32*a* and 32*b* whose section is rectangular. The grooves 32*a* are made at positions corresponding to the label portion 15*a* of the first mold member 10. The grooves 32*a* are directly cross to the air passageways 13*a* which are made in the label portion 15*a*, and extend over the whole width of the third mold member 30. Each of the grooves 32*a* is open on the right and the left sides of the third mold member 30.

On the other hand, the grooves 32*b* are made at positions corresponding to the neck portion 15*b* of the first mold member 10. The grooves 32*b* are parallel with the direction perpendicular to the air passageways 13*b* made in the neck portion 15*b*. The grooves 32*b* extend from the position corresponding to the neck portion of the first mold member 10 to the front face 33 of the third mold member and are open on the front face 33.

The third mold member 30 being disposed with its top face 31*a* in contact with the bottom face 11*b* of the first mold member 10, spaces surrounded by the bottom face 11*b* of the first mold member and the grooves 32*a* and 32*b* are formed between the members 10 and 30. The spaces provide steam discharge passageways 2*a* and 2*b* as passageways (second passageways) which connect the air passageways 13*a* and 13*b* to the outside of the mold and are perpendicular to the air passageways 13*a* and 13*b*.

More specifically, the steam discharge passageways include first steam discharge passageways 2*a* which interconnect the air passageways 13*a* provided in the label portion 15*a* of the first mold member 10 and the outside of the drying mold 1 and second steam discharge passageways 2*b* which interconnect the air passageways 13*b* provided in the neck portion 15*b* of the first mold member 10 and the outside of the drying mold 1. The steam discharge passageways 2*a* and 2*b* allow water vapor generated from the wet preform put into the depression 12 of the first mold member 10 to escape from the mold through the air passageways 13*a* and 13*b*.

The mold members 10, 20, and 30 are registered by means of registration members (not shown) such as dowel pins and fixed in a dismantle way by fixing means (not shown) such as bolts.

The drying mold 1 having the above-mentioned structure, the heat generated by the heating means of the second mold member 20 is indirectly conducted to the preform through the third mold member 30 and the first mold member 10. Compared with a structure having a heating means (such as a heater) embedded in the first mold member 10 that is in direct contact with a preform, temperature variation hardly occurs, and a preform can be dried uniformly. By sufficiently increasing the heat capacity of the first mold member 10, temperature variation is securely suppressed. This means that the temperature of the drying mold 1 hardly drops, which is particularly advantageous in drying a large number of preforms continuously.

When preforms of different shapes are to be dried in the drying mold 1, it is only the first mold member 10 that should be changed to adapt to different shapes of preforms. Where, for instance, the drying mold 1 is mounted on a drying apparatus as described later, the drying mold 1 can be fixed to a platen of the drying apparatus on the back of the second mold member 20. In case of changeover of molded items, only the first mold member 10 can be changed easily while the second mold member 20 and the third mold member 30 remain fixed to the platen. A heat insulating layer or a heat insulating member can be provided between the platen and the third mold member 30 whereby the heat generated from a prescribed heating means can be conducted to the preform efficiently while preventing heat dissipating to the main body of the drying apparatus through the platen. The platen can be cooled with a coolant such as water to suppress distortion of the drying apparatus due to thermal deformation.

In case the heating means is exchanged as the life expires, it is only the heating means or the second mold member that should be renewed. Therefore, the drying mold 1 has satisfactory maintainability.

Since the drying mold 1 is dismantle, it is easy to remove fine pulp fibers, additives, etc. entrained by water vapor and deposited on the parts of the drying mold 1. From the viewpoint, too, the drying mold 1 has satisfactory maintainability.

In carrying out drying a preform by the use of the drying mold 1 according to the present embodiment, a pair of the drying molds 1 are used. Two drying molds 1 are mated together on their parting faces (the top faces 11*a* of the first mold members 10) to form a cavity composed of the two depressions 12, in which a wet preform is put and dried. A preferred manner of drying a preform by using the drying mold 1 of the present embodiment is described with reference to FIGS. 5(*a*) through 5(*d*). For the sake of simplicity, the structure, the shape, and the like of the drying molds are simplified in FIGS. 5(*a*) to 5(*d*). The whole construction of the drying apparatus on which the drying molds are mounted is omitted.

As shown in FIG. 5(*a*), a pair of drying molds 1 and 1 are mated together on their parting faces to form a cavity 3 composed of the two depressions 12, in which a pulp molded preform 4 made by a prescribed wet papermaking process is fitted. The two drying molds 1 are heated to a prescribed temperature beforehand. Each drying mold 1 is attached and fixed to a platen of the drying apparatus not shown on the side of its second mold member 20, i.e., on the back side face 21*a* of the second mold member 20.

As shown in FIG. 5(*b*), a pressing member 5 having the shape of a hollow bag is inserted into the preform 4 while evacuating the drying molds 1 by suction from the inside to the outside through the steam discharge passageways (not shown). The pressing member 5 is preferably elastically stretchable. The pressing member 5 is preferably made of urethane, fluororubber, silicone rubber, elastomers, etc., which are excellent in tensile strength, impact resilience, and stretchability.

As shown in FIG. 5(*c*), a pressurizing fluid is supplied into the pressing member 5 to expand the pressing member 5. The wet preform is pressed by the expanded pressing member 5 against the concave side of the depressions 12. Drying of the preform 4 thus proceeds and, at the same time, the shape of the depressions 12 are transferred onto the preform. Steam generated from the preform 4 is discharged out of the molds through the above-described steam discharge passageways. Since the preform 4 is pressed from its inside to the outside against the depressions 12, it dries at a high drying efficiency however complicated the depressions 12 may be. Besides, the shape of the depressions 12 is transferred to the preform 4 with good precision. Since the air passageways formed on the depressions 12 have a slit form as stated, pressing by the pressing member 5 hardly leaves marks of the air passageways on the surface of the dried preform 4. The pressurizing fluid for expanding the pressing member 5 includes compressed air (heated air), oil (heated oil) and other various liquids. The pressure for feeding the pressurizing fluid is preferably 0.01 to 5 MPa, particularly 0.1 to 3 MPa.

After the preform 4 has dried sufficiently, the pressuring fluid is withdrawn from the pressing member 5 to shrink the pressing member 5 to its original size as shown in FIG. 5(*d*). The shrunken pressing member 5 is then removed from the molded article 4, and the drying molds 1 and 1 are opened to take out the molded article 4.

A second embodiment of the first aspect of the invention and a first embodiment of the second aspect of the invention will be described with reference to FIGS. 6 and 7. These embodiments will be described only with regard to differences from the above-described embodiment. The detailed description about the foregoing embodiment appropriately applies to the same particulars. The members in FIGS. 6 and 7 that are the same as those in FIG. 1 to FIG. 4 and FIGS. 5(*a*) to 5(*d*) are given the same reference numerals as in the latter.

The second embodiment of the first aspect of the invention will be described first. FIG. 6 represents a view corresponding to FIG. 4 of the first embodiment, a cross-section of a drying mold 1 across the label portion thereof. In this embodiment, the depression 12 of a first mold member 10 has a plurality of air passageways 13*c* and 13*d* of slit form as interconnecting passageways (first passageways) which connect the depression 12 and the side faces 11*c* and 11*d*, part of the exterior surface of the first mold member 10.

A second mold member 20 is the same as that of the first embodiment. The difference from the first embodiment lies in that the top face 21*a* of the second mold member 20 is in contact with the bottom face 11*b* of the first mold member 10.

A pair of third mold members 30 are disposed on the left and the right faces 11*c* and 11*d* which constitute part of the exterior surface of the first mold member 10. Each third mold member 30 has a plurality of grooves 32*c* or 32*d* having a rectangular section on its face facing the side face 11*c* or 11*d* of the first mold member 10. The grooves 32*c* and 32*d* extend over the whole height of the third mold members 30.

The third mold members 30 being disposed with their side face in contact with the side face 11*c* and 11*d* of the first mold member 10, spaces surrounded by the side faces 11*c* and 11*d* of the first mold member and the grooves 32*c* and 32*d* are formed between the members 10 and 30. The spaces provide steam discharge passageways 2*c* and 2*d* as second passageways connecting the air passageways 13*c* and 13*d* to the outside of the mold 1.

The first embodiment of the second aspect of the invention is then described. FIG. 7 represents a view corresponding to FIG. 4 of the first embodiment, a cross-section of a drying mold 1 across the label portion thereof similarly to FIG. 6. The drying mold 1 according to this embodiment is two-part construction having a first mold member 10 and a second mold member 20.

The first mold member 10 has a plurality of air passageways 13*a* of slit form in its depression 12, which interconnect the depression 12 and the bottom face 11*b*, a part of the exterior surface of the first mold member 10.

The second mold member 20 is in contact with the bottom face 11*b* of the first mold member on its top face 21*a*. The bottom face 21*b* of the second mold member 20 constitutes the back side of the drying mold 1. The second mold member 20 is removably equipped with a heating means (not shown) such as an electric heater.

A plurality of grooves 22 having a rectangular section are engraved on the top face 21*a* of the second mold member 20. The grooves 22 are parallel with the direction perpendicular to the air passageways 13*a* made in the first mold member 10 and extend over the whole width of the second mold member, Each groove 22 is open on both the left and the right faces 23*a* and 23*b* of the second mold member 20.

The second mold member 20 being disposed with its top face 21*a* in contact with the bottom face 11*b* of the first mold member 10, spaces surrounded by the bottom face 11*b* of the first mold member and the grooves 22 of the second mold member 20 are formed between the members 10 and 20. The spaces provide steam discharge passageways 2*e* as passageways (second passageways) the air passageways 13*a* of the first mold member to the outside of the drying mold 1 and are perpendicular to the air passageways 13*a* and 13*b*.

The drying molds according to the second embodiment of the first aspect and the first embodiment of the second aspect produce the same effects as with the drying mold according to the first embodiment of the first aspect of the invention.

The present invention is not limited to the aforementioned embodiments. For example, while in the first aspect of the invention grooves are made in the third mold member 30 on its face facing the exterior surface of the first mold member 10, whichever member has grooves is not particularly limited as long as there are formed the above-described steam discharge passageways (second passageways) between the first mold member and the third mold member brought into contact with each other. In the first embodiment, for example, grooves may be formed on the bottom face 11*b* of the first mold member instead of, or in addition to, the grooves 32*a* and 32*b* formed on the top face 31*a* of the third mold member. Likewise, in the second embodiment, grooves may be formed on the side faces 11*c* and 11*d* of the first mold member 10 instead of, or in addition to, the grooves 32*c* on the side of each third mold member 30. The same modifications apply to the second aspect of the invention. That is, grooves may be formed on the bottom face 11*b* of the first mold member 10 in place of, or in addition to, the grooves 22 formed on the top face 21*a* of the second mold member 20. The section of the grooves is not limited to a rectangle and can be of various shapes, such as a semicircle and a triangle.

The air passageways of slit form made in the first mold member 10 may be replaced with air passageways comprising circular through-holes. The first mold member 10 may be provided with a member having through-holes (e.g., a vented core) which can be utilized as air passageways. The first mold member 10 may be made of a sintered body of a particulate material, the pores of which can be utilized as air passageways. The first mold member 10 may be formed by electroforming, and pores of the electroformed mold can be used as air passageways.

The portion of the first mold member where air passageways are formed is not limited to the label portion 15*a* and the neck portion 15*b*. The air passageways can be appropriately formed at necessary portions according to the shape and the like of a molded article to be manufactured.

In order to improve uniformity of steam discharge, it is preferred that the steam discharge passageways 2*a*, 2*b*, 2*c*, 2*d*, and 2*e* be made narrower and aligned at smaller intervals, or it is preferred to form discharge passageways in a crossing pattern.

It is possible that a pair of drying molds 1 are joined together leaving a gap between the parting faces 11*a* of the two first mold members 10 so that the gap may serve as air passageways of slit form. It is also possible that the first mold member 10 is composed of a plurality of split pieces with a gap formed between parting faces of the pieces so that the gaps may serve as air passageways of slit form.

Although the drying portion of the first mold member 10 in each of the above-described embodiments is concavity, the drying portion could be convexity depending on the shape of a molded article.

In the second embodiment of the first aspect of the invention, the drying mold 1 can be attached to the platen of a drying apparatus on the side of either the second member 20 or the third member 30. Likewise, in the first embodiment of the second aspect of the invention, it can be fixed to the platen on the side of the second mold member 20.

While in the aforementioned embodiments the wet preform 4 is dried while being pressed by the pressing member 5, a male mold which fits the depression of the drying mold 1 may be used to press and dry the preform 4 according to the shape of the preform. Where the drying portion of the drying mold 1 is convexity, a female mold which fits the convexity can be used to press and dry the preform 4.

Industrial Applicability

The drying mold and the drying apparatus according to the present invention are effective to suppress non-uniformity of drying in drying a wet pulp molded preform.

The drying mold and the drying apparatus according to the present invention are flexible in drying preforms of various shapes.

The drying mold and the drying apparatus according to the present invention are excellent in maintainability.

What is claimed is:

1. A drying mold for a pulp molded article having a first mold member, a second mold member, and a third mold member, wherein said first mold member has a drying portion which is brought into contact with a wet pulp molded article, said first mold member has a linear first passageway connecting said drying portion to an exterior surface of said first mold member, said second mold member has a prescribed heating means and is disposed in contact with the exterior surface of said first mold member or on an exterior surface of said third mold member when said third mold member is disposed in contact with the exterior surface of said first mold member, and said drying mold is designed to form a linear second passageway between said first mold member and said third mold member when said first mold member and said third mold member are disposed in contact with each other, said second passageway connects said first passageway to the outside of said drying mold and is perpendicular to the first passageway.

2. An apparatus for drying a pulp molded article having a drying mold according to claim 1 and a platen to which the drying mold is fixed, wherein said drying mold is attached and fixed to said platen on the side of said second mold member or said third mold member.

3. A drying mold for a pulp molded article having a first mold member and a second mold member, wherein said first mold member has a drying portion which is brought into contact with a wet pulp molded article, said first mold member has a linear first passageway connecting said drying portion to an exterior surface of said first mold member, said second mold member has a prescribed heating means and is disposed in contact with the exterior surface of said first mold member, and said drying mold is designed to form a linear second passageway between said first mold member and said second mold member when said first mold member and said second mold member are disposed in contact with each other, said second passageway connects said first passageway to the outside of said drying mold and is perpendicular to the first passageway.

4. An apparatus for drying a pulp molded article having a drying, mold according to claim 3 and a platen to which the drying mold is fixed, wherein said drying mold is attached and fixed to said platen on the side of said second mold member.

5. A drying mold for a pulp molded article, comprising:

a first mold member having a drying portion configured to contact a wet molded article;

a second mold member; and a third mold member, wherein the first mold member includes a first passageway configured to connect the drying portion,to an exterior surface of the first mold member, the second mold member includes a heating apparatus and is configured to contact at least one of an exterior surface of the first mold member and an exterior surface of the third mold member, a second passageway is formed between the first mold member and the third mold member when the first mold member and the third mold member are in contact, and the second passageway is configured to connect the first passageway to an outside of the drying mold.

6. The drying mold according to claim 5, wherein the first passageway is perpendicular to the second passageway.

7. The drying mold according to claim 5, further comprising a platen to which the drying mold is configured to be mounted.

8. The drying mold according to claim 7, wherein the drying mold is attached to the platen on the side of at least one of the second mold member and the third mold member.

9. A drying mold for a pulp molded article, comprising:

a first mold member having a drying portion;

a second mold member;

a first passageway configured to connect the drying portion to an exterior surface of the first mold member; and a second passageway formed between the first mold member and the second mold member when the first mold member and the second mold member are in contact, wherein the first mold member includes a drying portion configured to contact a wet pulp molded article, the second mold member includes a prescribed heating means and is positioned in contact with the exterior surface of the first mold member, and the second passageway connects the first passageway to an outside of the drying mold.

10. The drying mold according to claim 9, wherein the first passageway is perpendicular to the second passageway.

11. The drying mold according to claim 9, further comprising a platen to which the drying mold is configured to be mounted.

12. The drying mold according to claim 11, wherein the drying mold is attached to the platen on a side of the second mold member.

* * * * *

UNITED STATES PATENT AND TRADEMARK OFFICE

CERTIFICATE OF CORRECTION

PATENT NO. : 6,857,199 B2
DATED : February 22, 2005
INVENTOR(S) : Otani et al.

It is certified that error appears in the above-identified patent and that said Letters Patent is hereby corrected as shown below:

Title page,
Item [30], Foreign Application Priority Data, should read,
-- [30] Foreign Application Priority Data
Mar. 23, 2000 (JP)……...2000-81443 --

Signed and Sealed this

Tenth Day of May, 2005

JON W. DUDAS
*Director of the United States Patent and Trademark Office*